US005152366A

United States Patent [19]

Reitz

[11] Patent Number: 5,152,366

[45] Date of Patent: Oct. 6, 1992

[54] SOUND ABSORBING MUFFLER

[75] Inventor: Ronald P. Reitz, Hyattsville, Md.

[73] Assignee: The United States of America as represented by the Secretary of the Navy, Washington, D.C.

[21] Appl. No.: 676,506

[22] Filed: Mar. 28, 1991

[51] Int. Cl.[5] ..... F01N 1/02

[52] U.S. Cl. ..... 181/249; 181/252; 181/264; 181/270; 181/280

[58] Field of Search ..... 181/247, 248, 249, 252, 181/255, 264, 269, 270, 279, 280, 281, 282

[56] References Cited

U.S. PATENT DOCUMENTS

| | | | |
|---|---|---|---|
| 1,157,256 | 10/1915 | Schmitt | 181/279 |
| 2,101,389 | 12/1937 | Fisher | 181/247 |
| 2,185,489 | 11/1940 | Wilman | 181/279 |
| 2,198,730 | 4/1940 | Kadenacy | 181/279 |
| 2,541,373 | 2/1951 | McLeod | 181/247 |
| 2,646,854 | 7/1953 | Walker | 181/280 |
| 2,798,569 | 7/1957 | Fisher, Jr. | 181/264 |
| 2,807,137 | 9/1957 | Meulien et al. | 181/212 X |
| 2,841,235 | 7/1958 | Curioni | 181/279 |
| 2,914,132 | 11/1959 | Bourne et al. | 181/252 |
| 3,132,717 | 5/1964 | Baruch | 181/264 |
| 3,141,520 | 7/1964 | Kurtze | 181/247 |
| 3,187,837 | 6/1965 | Beeching | 181/246 |
| 3,348,629 | 10/1967 | Cassel | 181/232 |
| 3,470,689 | 10/1969 | Gurr | 181/212 X |
| 3,483,942 | 12/1969 | Crowell et al. | 181/175 |
| 3,765,506 | 10/1973 | Strunk | 181/252 |
| 3,884,655 | 5/1975 | Coop | 181/264 |
| 4,091,892 | 5/1978 | Hehmann et al. | 181/286 |
| 4,108,275 | 8/1978 | Black | 181/252 |
| 4,239,091 | 12/1980 | Negrao | 181/243 |
| 4,335,797 | 6/1982 | Simmons | 181/204 X |
| 4,371,054 | 2/1983 | Wirt | 181/252 |
| 4,378,859 | 4/1983 | Satomi et al. | 181/224 |
| 4,393,652 | 7/1983 | Munro | 181/252 X |
| 4,421,202 | 12/1983 | Hoy | 181/252 |
| 4,522,283 | 6/1985 | Smith | 181/175 |

FOREIGN PATENT DOCUMENTS

| | | | |
|---|---|---|---|
| 68157 | 4/1958 | France | 181/280 |
| 1200459 | 12/1959 | France | 181/280 |

*Primary Examiner*—Michael L. Gellner
*Assistant Examiner*—Khanh Dang
*Attorney, Agent, or Firm*—Charles D. Miller

[57] ABSTRACT

A sound absorbing muffler constuction is provided. The muffler includes a gas conduit having an unobstructed gas flow path and a plurality of perforations passing through its walls along a portion thereof. A sound attenuator body encases the perforated portion of the gas conduit such that a sound absorbing space is formed between the outer wall of the gas conduit and the inner wall of the sound attenuator body. A plurality of parabolically shaped baffles are located in the sound absorbing space. Each baffle is radically disposed and axially extended along the direction of the gas flow. The baffles direction the propagation of acoustic energy entering the sound absorbing space such that the energy traverses a substantially longer path than if no baffles were present. Thus, the acoustic energy is subject to a greater amount of possible attenuation within the sound absorbing space.

8 Claims, 2 Drawing Sheets

SOUND ABSORBING MUFFLER

The invention described herein may be manufactured and used by or for the Government of the United States of America for governmental purposes without payment of any royalties thereon or therefor.

FIELD OF THE INVENTION

The invention relates generally to mufflers and more particularly to a sound absorbing muffler that uses a plurality of baffles to direct the propagation of acoustic energy within the muffler such that the path length of the acoustic energy within the muffler is maximized.

BACKGROUND OF THE INVENTION

Many sound absorbing mufflers for flowing gas systems have utilized a variety of chronologically developed generic design techniques. One technique involves "scooping" some of the gas flowing through the muffler to excite resonant chambers found within the muffler. Unfortunately, scooping the gas requires interrupting the flow of the gas which can create significant back pressure in the system. Accordingly, if the scooped gas technique were used in the design of an automobile muffler, a significant loss in engine efficiency would result.

In order to alleviate the problems caused by interrupting the gas flow, another technique involves placing the resonant chambers within the expansion chamber. However, these types of mufflers are limited to attenuating specific tones or frequencies. Thus, broadband sound and high frequency noise is largely unaffected and may radiate from the muffler.

Accordingly, the next phase of muffler development addressed the aforementioned limited frequency drawbacks. To do so, acoustically absorptive materials were employed to dissipate broad frequencies of sound within muffler designs that permitted a largely unrestricted gas flow through the muffler. Unfortunately, the size and weight of these designs proved prohibitive in many space sensitive applications.

SUMMARY OF THE INVENTION

Accordingly, it is an object of the present invention to provide a sound absorbing muffler for maximizing acoustic sound absorption while minimizing gas flow restrictions as well as size/weight characteristics.

Other objects and advantages of the present invention will become more obvious hereinafter in the specification and drawings.

In accordance with the present invention, a sound absorbing muffler is provided to achieve the aforementioned objects. In particular, a gas conduit defines a cavity for gas flow therethrough in a predetermined direction. The gas conduit has perforations passing through its walls along a portion thereof. A sound attenuator body is provided to encase at least the perforated portion of the gas conduit. The encased volume defined between the outer wall of the gas conduit and the inner wall of the sound attenuator body is utilized as a sound absorbing space. A plurality of sound reflecting baffles are radially disposed and axially extended in the predetermined direction of gas flow within the sound absorbing space. The gas conduit provides for unrestricted gas flow while the baffles direct the propagation of acoustic energy within the sound absorbing space such that the path length of the acoustic energy within the sound absorbing space is maximized. The maximum path length created by the baffles within the sound absorbing space allows for improved sound attenuation.

BRIEF DESCRIPTION OF THE DRAWINGS

FIG. 3(*b*) is a cross-sectional view of yet another alternative embodiment as viewed along the predetermined direction of gas flow.

DETAILED DESCRIPTION OF THE INVENTION

Figure 1:
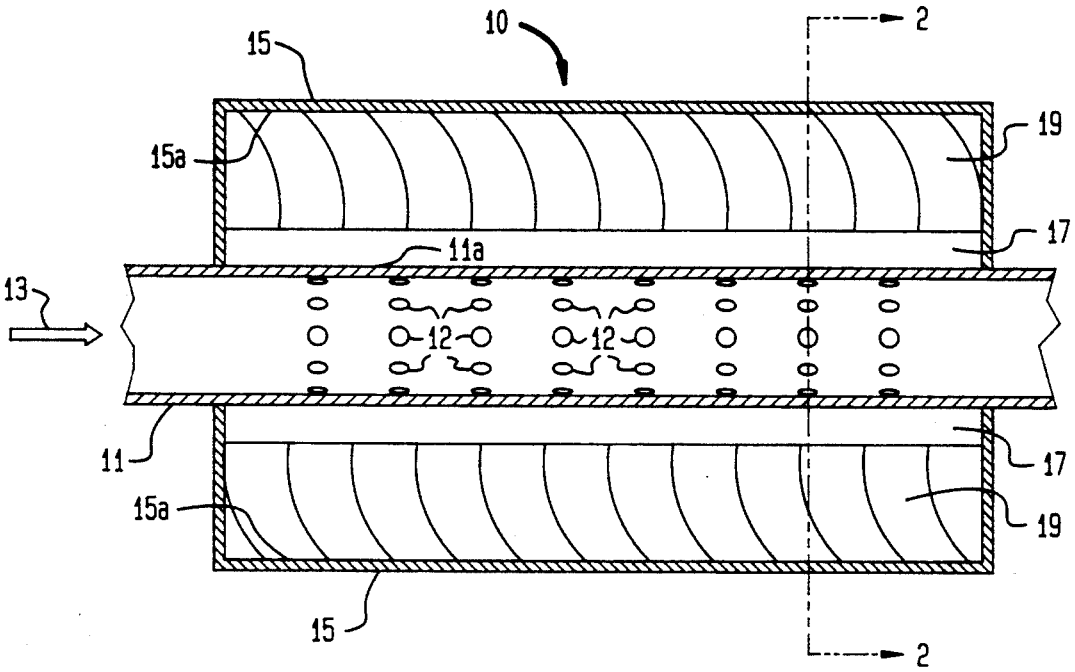
FIG. 1 is a side, cross-sectional view of the sound absorbing muffler according to the present invention.

Referring now to the drawings, and in particular to FIG. 1, a side, cross-sectional view is shown of the sound absorbing muffler 10 according to the present invention. While the following description will focus on the muffler 10 shown in FIG. 1, it will be readily apparent that the component parts of muffler 10 may vary in shape and size (depending on the application) without departing from the scope of the instant invention's novel features. Only those elements essential to muffler 10 are shown for clarity and ease of description.

Accordingly, muffler 10 includes a gas conduit 11 that defines a cavity for a gas flow in a predetermined direction. Such a gas flow is indicated by flow arrow 13. Gas conduit 11 has a plurality of perforations 12 that pass through its walls along a portion thereof as shown. The quantity, size and shape of perforations 12 is a design choice and in no way constrains the present invention. Similarly, the size, shape and material used for gas conduit 11 is a design choice unrelated to the novel features of the present invention.

The portion of gas conduit 11 having perforations 12 is encased by a sound attenuator body 15. The volume of space defined between the outer wall 11*a* of gas conduit 11 and the inner wall 15*a* of sound attenuator body 15 forms a sound absorbing space 17 all around gas conduit 11. Within sound absorbing space 17 are a plurality of sound reflecting baffles 19 radially disposed and axially extended within space 17 along the direction of gas flow 13. A better appreciation of the relationship between the sound absorbing space 17 and baffles 19 is obtained by referring to FIG. 2.

Figure 2:
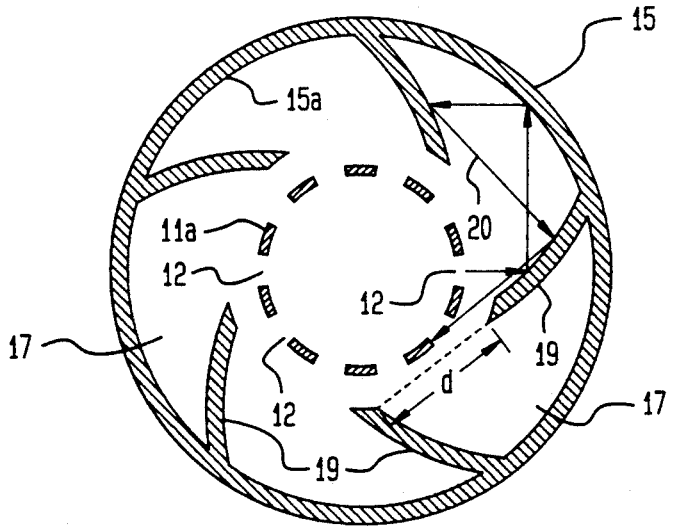
FIG. 2 is a cross-sectional view along line A—A in FIG. 1, as viewed along the predetermined direction of gas flow.

FIG. 2 is a cross-sectional view along line A—A in FIG. 1 such that FIG. 2 is viewed in the direction of gas flow 13. Common reference numerals will be used for those elements common with FIG. 1. As is readily apparent, the sound absorbing space 17 includes the volume as defined above. Baffles 19 are attached to, or may be integral with, the inner wall 15*a* of sound attenuator body 15. Typically, baffles 19 are parabolically curved in their radial dimension as shown; however, their shape is not so limited as will be described further hereinbelow.

In operation, gas flow 13 passes through conduit 11 with minimal flow restriction since no component part of muffler 10 is placed in its path. At the same time, perforations 12 allow acoustic energy carried by gas flow 13 to enter the sound absorbing space 17. A representative path 20 of the acoustic energy is shown within space 17. Path 20 runs from the outer wall 11*a* to the inner wall 15*a* and then back to the outer wall 11*a*. Along the way, path 20 reflects off a plurality of baffles 19 and the inner wall 15*a*. Without baffles 19, the acoustic energy would only travel directly to the outer wall 15*a* and then back to the inner wall 11*a*. Accordingly, without baffles 19, a much larger diameter sound attenuator body 15 would be required to create a path as long as path 20. This, however, would greatly increase the size/weight characteristics of the muffler.

Since the attenuation of the acoustic energy takes place within sound absorbing space 17, it is desirable to trap the acoustic energy within space 17 for as long as possible. Accordingly, maximizing the length of path 20 becomes paramount. In order to accomplish this, baffles 19 should be shaped such that the length of path 20 is equal to one quarter wavelength of the lowest frequency of acoustic energy to be attenuated.

The number of baffles 19 shown in FIG. 2 is purely representative. In actuality, the number of baffles used is based on the length of path 20. Specifically, the distance d between the axially extended edges of any two adjacent baffles 19 should be less than, or equal to, the length of path 20.

Note that the inventive shape and placement of baffles 19 provide for increased sound attenuation within the sound absorbing space 17. Accordingly, it is possible to improve sound attenuation even if space 17 is filled only with air/gas. Sound is absorbed in air by friction between the air molecules themselves and by friction between the air molecules and baffles 19. If the motion of the air molecules is due to sound excitation, then the frictional losses will be losses in the sound energy.

However, the attenuation characteristics of muffler 10 may be further enhanced by providing sound absorptive material (not shown) in sound absorbing space 17. There are many kinds of sound absorbing materials that may be used such as copper wool, concrete, fiberglass insulation or metal felt. It is to be appreciated that the present invention is not limited to these materials alone. The method used to choose the best material for a particular application is well-known in the field of sound attenuation. Accordingly, further detail on this subject is not required to understand the instant invention.

It is important that an acoustic impedance mismatch is achieved within the sound absorbing space 17 as the acoustic energy traveling along path 20 impinges on the baffles 19, the inner wall 15*a* and the outer wall 11*a*. In this way, the acoustic energy to be attenuated remains trapped within the sound absorbing space along path 20.

Figure 3A:
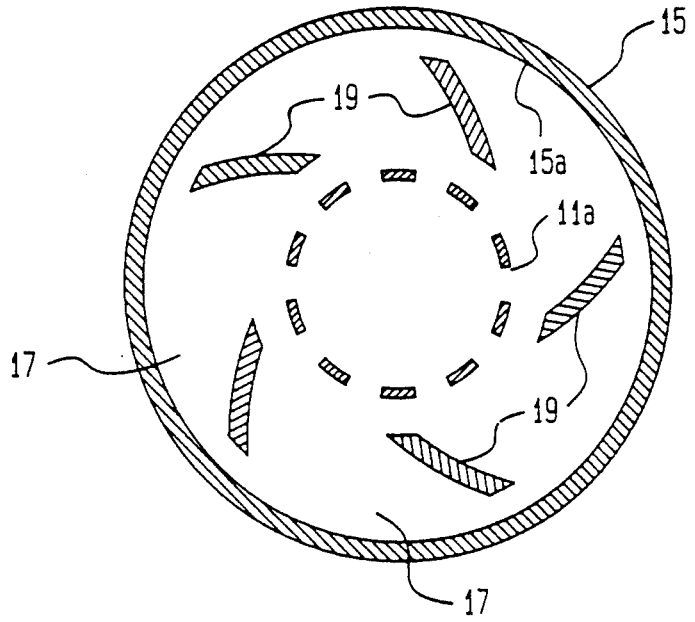
FIG. 3(*a*) is a cross-sectional view of an alternative embodiment of the present invention as viewed along predetermined direction of gas flow.
Figure 3B:
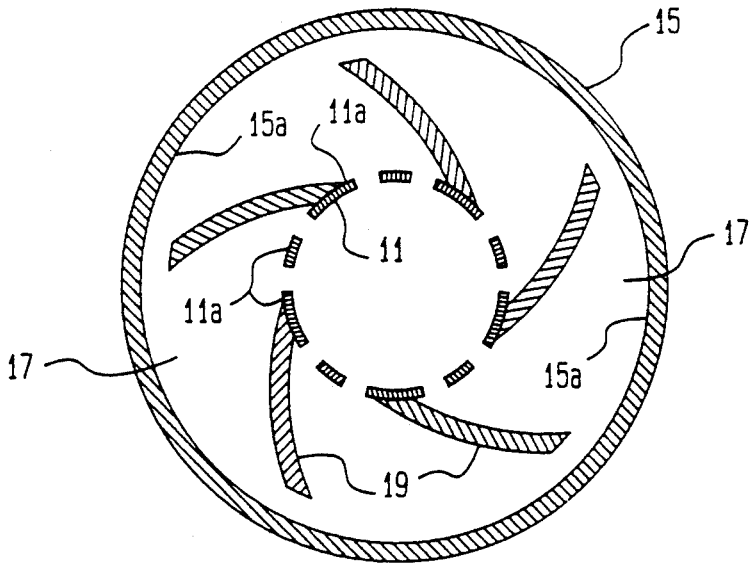

Baffles 19 may, but need not necessarily be attached to (or be integral with) inner wall 15*a*. Indeed, baffles 19 might be suspended and held in place within sound absorbing space 17 by the sound absorbing material. This alternative embodiment is shown in FIG. 3(*a*) and, similar to FIG. 2, is a cross-sectional view along the direction of gas flow 13. For sake of clarity, no sound absorbing material is shown in FIG. 3(*a*). However, it is to be understood that such sound absorbing material will serve to hold baffles 19 in place. In yet another embodiment, baffles 19 may be attached to (or may be integral with) the inner wall 11*a* of gas conduit 11. This alternative embodiment is shown in FIG. 3(*c*).

The advantages of the present invention are numerous. A muffler's acoustic energy attenuation is improved by using appropriately shaped baffles to increase the path length of such energy within the muffler's sound absorbing space. The use of shaped (e.g. parabolically curved) baffles permit a reduction in the diameter of the sound attenuator body. This reduces the muffler's size/weight characteristics. Finally, by keeping the gas flow essentially unobstructed within the gas conduit, the efficiency of the system connected to the sound absorbing muffler is maximized.

Furthermore, although the invention has been described relative to a specific embodiments thereof, there are further variations and modifications that will be readily apparent to those skilled in the art in the light of the above teachings. It is therefore to be understood that, within the scope of the appended claims, the invention may be practiced other than as specifically described.

What is claimed is:

1. A sound absorbing muffler, comprising:

a gas conduit having walls including an outer wall defining a cavity for gas flow therethrough in a predetermined direction, said gas conduit further having perforations passing through its walls along a portion thereof;

a sound attenuator body having walls including an inner wall encasing at least said perforated portion of said gas conduit wherein a sound absorbing space is defined between the outer wall of said gas conduit and the inner wall of said attenuator body; and a plurality of sound reflecting baffles radially disposed between the said conduit and said attenuator body and axially extended in the predetermined direction of gas flow within the sound absorbing space, each of said baffles being parabolically curved.

2. A sound absorbing muffler as in claim 1, wherein acoustic energy to be attenuated passes through said gas conduit perforations to traverse a path in the sound absorbing space running from the outer wall of said gas conduit to the inner wall of said sound attenuator body and then back to the outer wall of said gas conduit, said path further causing the acoustic energy to impinge on a plurality of said baffles as well as the inner wall of said sound attenuator body, wherein said baffles are shaped such that the length of said path is equal to one quarter wavelength of the lowest frequency of the acoustic energy to be attenuated.

3. A sound absorbing muffler as in claim 2, wherein an acoustic impedance mismatch is formed between the sound absorbing space and 1) said baffles, 2) the outer wall of said sound attenuator body, and 3) the inner wall of said gas conduit.

4. A sound absorbing muffler as in claim 1 further including sound absorbing material within the sound absorbing space.

5. A muffler as in claim 1 wherein the said baffles are rigidly affixed to the walls of said attenuator body and are spaced from the walls of said conduit.

6. A sound absorbing muffler as in claim 5, wherein the distance between the axially extended edges of any two adjacent baffles is less than, or equal to, the length of said path.

7. A muffler as in claim 1 wherein the said baffles are rigidly affixed to the walls of said conduit and are spaced from the walls of said attenuator body.

8. A muffler as in claim 4 wherein the said baffles are spaced from the walls of said attenuator body and spaced from the walls of said conduit, said baffles being held in place by said sound absorbing material.

* * * * *